US007900375B2

(12) United States Patent
Thoraval

(10) Patent No.: US 7,900,375 B2
(45) Date of Patent: Mar. 8, 2011

(54) BALLET POINTE SHOES

(76) Inventor: Michael Thoraval, Barnet (GB)

( * ) Notice: Subject to any disclaimer, the term of this patent is extended or adjusted under 35 U.S.C. 154(b) by 658 days.

(21) Appl. No.: 12/011,517

(22) Filed: Jan. 28, 2008

(65) Prior Publication Data

US 2008/0209761 A1 Sep. 4, 2008

(30) Foreign Application Priority Data

Jan. 30, 2007 (GB) ..... 0701697.5

(51) Int. Cl.
*A43B 5/12* (2006.01)

(52) U.S. Cl. ..... 36/8.3; 36/76 R; 12/146 S

(58) Field of Classification Search ..... 36/8.3, 36/103, 107, 108, 76 R, 76 C; 12/146 S, 12/146 D See application file for complete search history.

(56) References Cited

U.S. PATENT DOCUMENTS

| | | | | |
|---|---|---|---|---|
| 1,692,225 | A * | 11/1928 | Roberts | 36/8.3 |
| 1,813,561 | A | 3/1929 | Capezio | |
| 2,025,521 | A * | 12/1935 | Moss | 36/76 R |
| 2,097,958 | A * | 11/1937 | Uger | 36/180 |
| 2,269,562 | A * | 1/1942 | Stritter | 36/76 R |
| 2,810,214 | A | 11/1955 | Wolfe | |
| 4,412,393 | A | 11/1983 | Terlizzi, Jr. et al. | |
| 4,453,996 | A | 11/1983 | Terlizzi, Jr. et al. | |
| 5,740,618 | A | 4/1998 | Minden | |
| 6,775,930 | B2 * | 8/2004 | Fuerst | 36/103 |
| 6,895,694 | B2 | 5/2005 | Nye | |
| 7,254,904 | B2 | 8/2007 | Nye | |
| 2008/0034613 | A1 | 2/2008 | Wilkenfeld et al. | |
| 2010/0126042 | A1 * | 5/2010 | Wyon | 36/98 |

* cited by examiner

*Primary Examiner* — Marie Patterson
(74) *Attorney, Agent, or Firm* — Baker & Rannells, PA

(57) ABSTRACT

Disclosed herein is an improved design and construction for Ballet Pointe Shoes using a box and shank that interlock in an over-under fashion, where the shank is designed with a cavity that allows varying rigidities along its length.

13 Claims, 3 Drawing Sheets

BALLET POINTE SHOES

CROSS REFERENCE TO RELATED APPLICATIONS

The present application is related to and claims priority from Great Britain application GB 0701697.5 filed on Jan. 30, 2007.

FIELD OF THE INVENTION

The present invention is a new and improved modular design for the construction of a Ballet Pointe Shoe which includes new component parts and incorporates into the improved design a lining material which absorbs the shocks generated when the shoes are in use and which are normally transmitted directly to the wearers' feet. The said lining material, which absorbs transmitted shocks, is a soft flexible material which changes to a more rigid material when the said material is impacted

BACKGROUND OF THE INVENTION

The construction of traditional ballet pointe shoes, also known as "pointe" shoes, has changed very little in recent times. The better shoes tend to be hand made and many are manufactured to a particular dancer's individual specification. They often require accuracy to within 3 mm particularly for the block which is the part of the shoe into which the dancer's toes are placed.

The manufacturing process is most often done by the traditional "turn shoe" method. The shoes are made inside out only being turned "right side" after the block, which is referred to later, has been constructed. The shoe is formed and pleated at the toe and then stitched which is the process whereby the sole is joined to the upper by means of a wax thread. Once the shoe had been stitched it is removed from the last and turned right side out and the block and the insole can be added.

The block is the most important part of the shoe. It is usually manufactured by hand and is built up layer by layer from Hessian triangles, paper and glue. The basis of the glue is a simple flour and water paste into which different manufacturers add their own preferred additives.

When the block is added to the shoe it is not dry and can be shaped, frequently with the aid of a smooth hammer which is also used to shape the platform which is the flat part at the front of the shoe. The shoe is then placed in an oven to dry completely.

A correctly fitted shoe is essential for dancers because there is a constant risk of stress injury to a dancer's feet and the last part of the manufacturing process is to make the shoe a customised item by fashioning at the vamp, which is the top of the block, plus the side and back prior to cutting down and binding the shoe.

Traditional construction methods and materials are retained by various manufacturers because it is believed that it builds into the shoe the correct amount of flexibility together with the ability for the shoe to absorb shocks. This shock absorbing ability is created by the construction of the block in that it needs to be a close fit to the foot. This close fit then ensures that when the foot is warm and the foot swells, the air which is inside the block expands and acts as a shock absorber to prevent impact stresses damaging the feet. This process is not perfect but is the best which can be achieved with the traditional type of construction so far described.

SUMMARY OF THE INVENTION

It is the object of the present invention to provide a solution to the problem of impact generated stresses which are transmitted to the wearers foot by taking a new approach to the design and construction of Ballet "pointe" shoes which also entails the use of new materials whereby different new materials are used in different parts of the shoe. One such material in particular is used as a lining for the box and insole and has the properties of being soft and flexible until impacted when it becomes more rigid and constitutes an impact guidance system otherwise known as I.G.S™. This particular material returns to its more flexible state when the impact movement has ceased. No novelty is claimed for the material itself, its applications are well known in the art. However this invention teaches both an improved design and construction for ballet pointe shoes in particular and the use of this type of shock absorbing material in the particular way described which allows the shoe to form around the foot and become a close fit and then absorb shock by becoming more rigid on receipt of a shock. This additional and temporary rigidity supports the foot and helps to prevent stress injury to the foot.

Any material with the properties described above may be used for the lining inside the box. A preferred material which performs this function is d30™ which in use is mixed into a solution containing foam. Typically 40% foam would be added but any suitable mixer in any suitable quantity may be used. This material contains intelligent molecules which react instantly to deliver shock absorption and impact support.

The shell of the shoe, also known as the block, is based upon a single piece moulding. Any suitable material may be used for this moulding and an example of a suitable material would be one which was a thermoplastic polyester elastomer such as a commercially available material known as Hytrel®. This moulding begins as a relatively flat, formed piece, which is bent around to become the shell. It is glued at a point where the two ends meet to form the centre of the sole of the shoe. The sides of the shell are shaped during moulding to engage the shape of the side of the foot at points where the highest deformations occur during use and this feature is described as Biomorphic™ technology The box which is inserted into the shell is made from a suitable material which is preferable but not exclusively a plastic. This material is formed into the shape of the box by a moulding process and is designed to provide rigidity at the toe which is also known as the platform and be relatively soft at the top of the box which is known as the vamp. The box also becomes more flexible as the material is taken further away from the platform.

The box is shaped to receive the insole sometimes known as the shank which is shaped to engage with the box in an over and under fashion so that the two items are locked together. This design is known as C-Lock™ technology and provides smooth support to the metatarsals. The shank is so formed as to be increasingly flexible towards the heel and would be manufactured from a different material than that used for the block itself. It is formed with a cavity in it's centre to provide maximum traction and surface contact, a feature which is known as C-Trek™ technology. The two materials of the shank and the block which would be of different densities are matched to provide flexibility in the right place and rigidity in the right place and also provide smooth control on the ball of the foot. This ability to provide smooth control is know as DuoMax™ technology, it is designed to ensure that the shoe is flexible when walking and provides support where required when dancing.

In a preferred version of the box a small piece of material is added to the front of the platform to reduce the sound generated by the platform striking the floor. This material is preferably but not exclusively the same d3o™ material as has been previously described herein.

The final stages in the assembly of this new design are to add a conventional covering and a conventional sole to the shoe which transforms the appearance of the shoe to that of an existing conventionally constructed pointe shoe.

According to the invention there is provided a ballet pointe shoe which incorporates a layer on the inside of the box which layer contains a material which in use reacts to applied shock loading by increasing its stiffness to provide impact support to the wearers foot.

According to a second aspect of the invention there is provided a ballet pointe shoe according to the first aspect where the shell of the shoe is formed as a one piece flat moulding which is then formed into a finished shell by locking and gluing teeth together which teeth are formed in the two opposing ends of the shell moulding.

According to a third aspect of the invention there is provided a ballet pointe shoe according to the first aspect or the first and second aspects where the shell or whatever may be used as a substitute or alternative to the shell, has an insert consisting of the box and the shank which are both interlocked to form one component.

According to a fourth aspect of the invention there is provided a ballet pointe shoe according to the third aspect where the box is constructed so as to be thinner and more flexible at the top (sometimes known as the vamp), when in use than at the bottom.

According to a fifth aspect of the invention there is provided a ballet pointe shoe according to the fourth aspect where the shank is solid where it engages with the box and more flexible towards the heel.

BRIEF DESCRIPTION OF THE DRAWINGS

The invention will now be more particularly described, by way of example, with reference to the drawings in which:—

DETAILED DESCRIPTION

Figure 1:
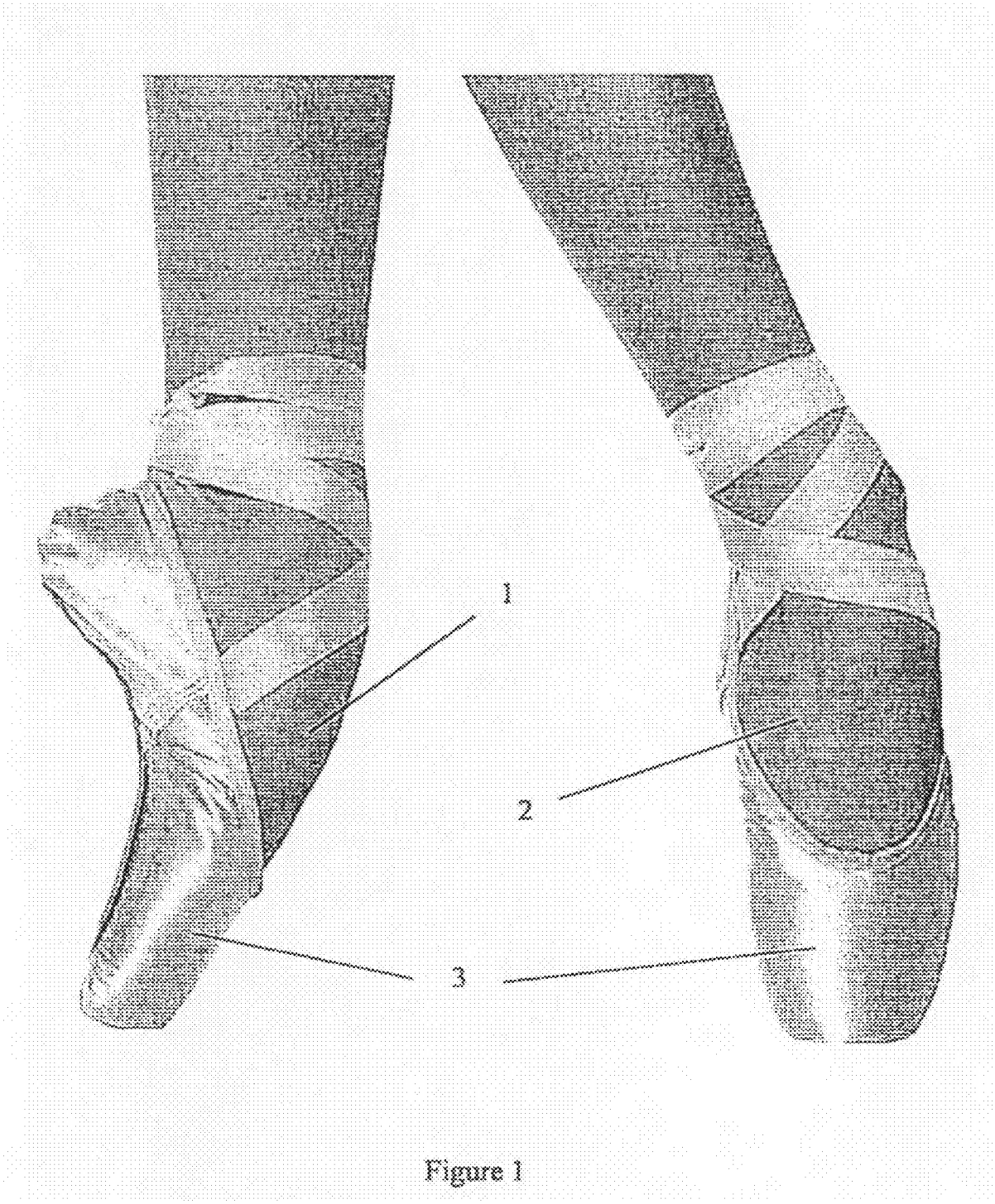
FIG. 1. This shows a pair of Ballet Pointe Shoes in use illustrating the flexibility required in the shank of the shoe.

Referring now to FIG. 1, a pair of ballet (pointe) shoes are shown in use. It can clearly be seen that the weight of the dancer is transferred entirely to the box area 3, in the front of the shoes, which is where all of the shocks generated by the dancers contact with the floor, are transferred to the feet. Also from the view of the right foot 1, it is clear that flexibility in the shank is very important.

Figure 2:
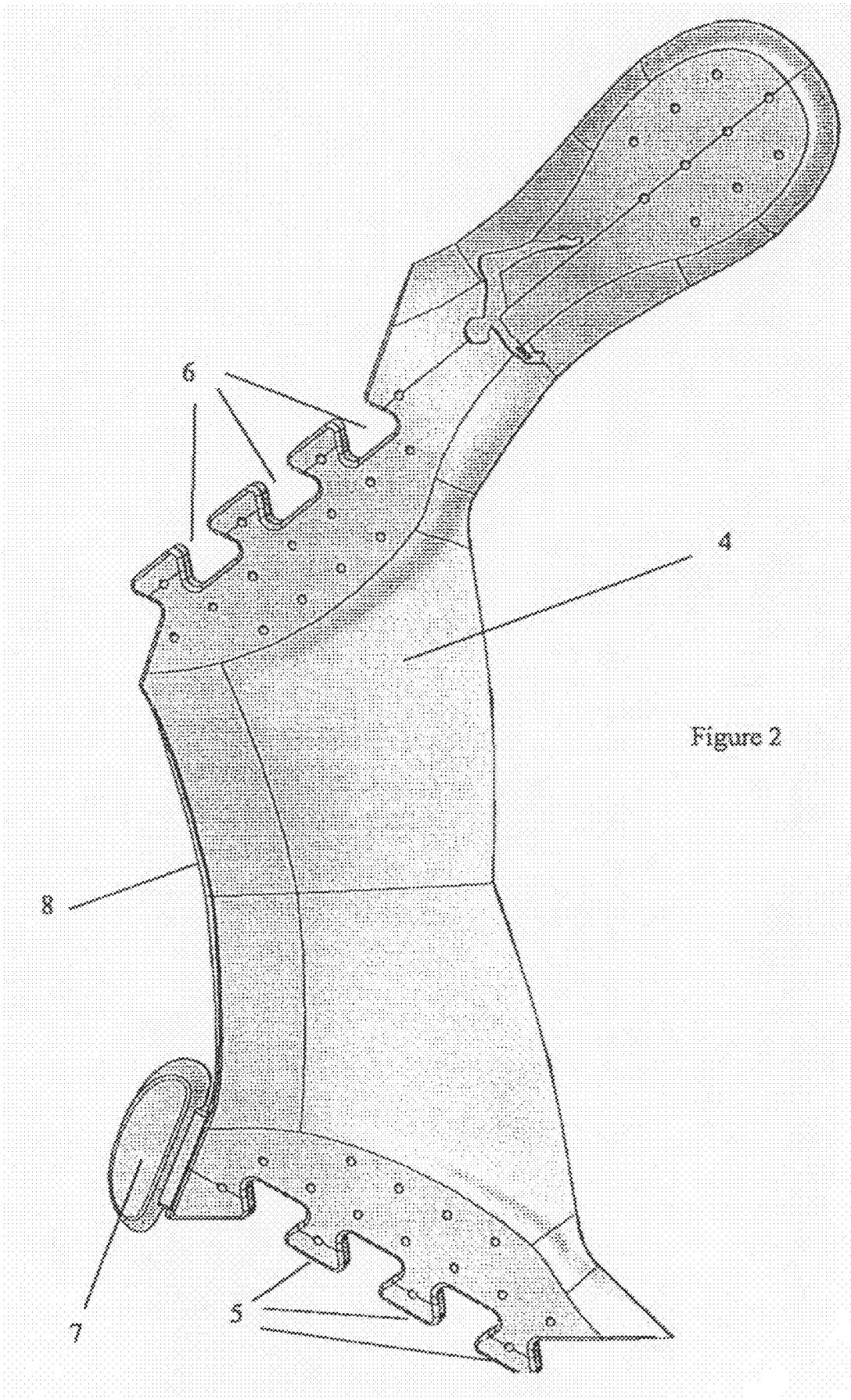
FIG. 2. Shows the form of the shell before it is bent around and the teeth joined to form the basic shape of the shoe.

The basis of the shape of the shoe is the shell shown in FIG. 2, which begins life as a flat component 4, as illustrated and is bent around to form the final shell shape. This component 4, is joined by connecting the joining teeth 5 with cavities 6 and bending the platform 7, to meet surface 8 when the shell is formed.

Figure 3:
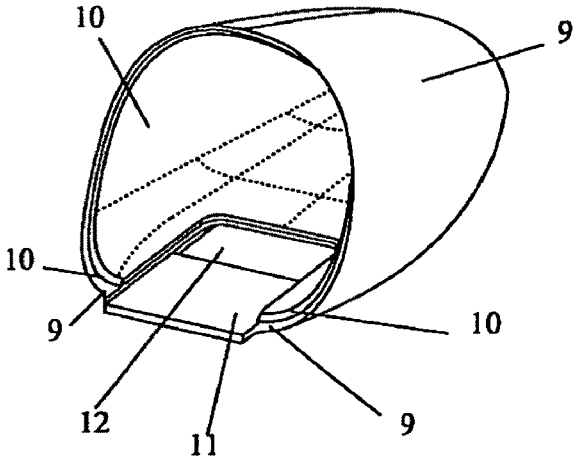
FIG. 3 Illustrates the box showing the inner lining and the slots and recesses which are formed to accept the shank.
Figure 4:
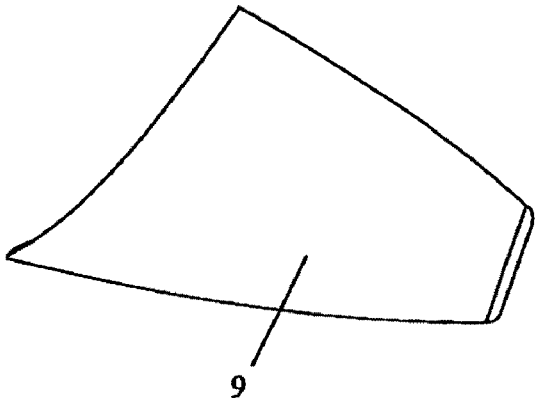
FIG. 4. Is a side view of the outside of the box illustrating the platform at the front of the box.

The box 9, is shown in FIGS. 3 and 4. it has a lining 10, formed from a material designed to become more rigid when receiving an impact and then return to a higher level of flexibility when the shock loading has passed. This lining may take any suitable shape inside the box but is restricted to the inside of the box only.

Figure 5:
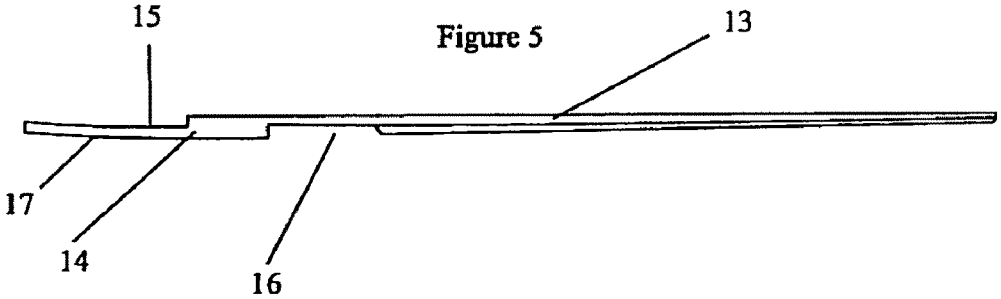
FIG. 5. Shows a side view of the shank where the detail of the shape required for locking the shank to the box can be seen.

The box is formed at 11 and 12, to accept the shank 13 which is shown in side view in FIG. 5. The box has a recess 11 and an opening 12 for receiving the shank. The front of the shank 14, is passed through the box opening 12. Surface 15 rests against the underside of the box and cavity 16 engages with recess 11.

Figure 6:
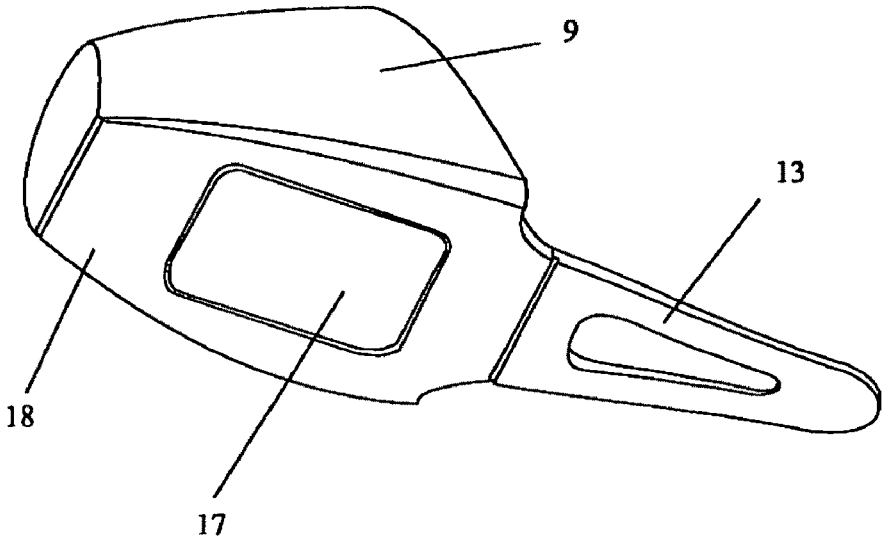
FIG. 6. Illustrates the box and the shank locked together to form one component which is inserted in the shell.

The final assembly is illustrated in FIG. 6, where the shank 13 can be seen locked to the box 9 and surface 17 of the shank is visible on the underside 18 of the box 9.

The remaining part of the construction is more conventional and will not be described in detail here. After the box and shank assembly are inserted into the shell then conventional lining materials and sole/insole materials are used to give the shoe the appearance of a conventionally constructed ballet shoe.

The example given in the above description is just one example of many different ways of constructing ballet pointe shoes according to the invention. The invention described herein is intended to include any method of producing ballet pointe shoes which incorporates the use of a shock absorbing material, particularly but not exclusively as a lining with properties as described in which the rigidity of the material changes upon receipt of stress or an impact.

The invention is extended to include the use of the said shock absorbing material together with any box, shank or shell either singly or in combination as described herein or any alternative design which fulfils the same function or functions as one or all of the components describes as the box, the shank or the shell.

What is claimed is:

1. A pointe shoe having a shell, a box, a lining that is formed on the inner surface of shell said lining having shock loading reactivity properties, and a shank; said box having an underside, a recess and an opening for receiving said shank, said shank having a front, a cavity, and a surface; said cavity of said shank configured to mate with said recess of said box;

Wherein said front of said shank passes through said opening of said box, said surface of said shank rests against said underside of said box, and said cavity of said shank engages with said recess of said box.

2. The point shoe of claim 1, wherein said shell, is designed and configured from a single piece moulding including a platform, a surface, teeth and cavities, Wherein said shell is formed by bending and joining by said teeth and said cavities such that said platform meets said surface.

3. The point shoe of claim 1, wherein said shell is made of thermoplastic polyester elastomer.

4. The point shoe of claim 1, wherein said box has a toe and a vamp, wherein said toe is configured and designed to be substantially rigid and said vamp is configured and designed to be substantially soft.

5. The point shoe of claim 4 wherein said box increases in flexibility in a direction opposite of said toe.

6. The point shoe of claim 1, wherein material is added to the front of said box to reduce sound.

7. The point shoe of claim 1 wherein said shank is more flexible toward one end.

8. The point shoe of claim 1 wherein said shell and said shank are comprised of materials with different densities.

9. The point shoe of claim 1 further comprising a covering and a sole.

10. A method of manufacturing a pointe shoe comprising the steps of:

(a) Providing a shell;

(b) Inserting a box into said shell;

(c) Engaging said box and a shank in an over-under fashion to interlock the box and the shank; and (d) Adding a covering and a sole.

11. The method of claim 10 further comprising the step of adding material to the front end of the box to reduce sound.

12. The method of claim 10 further comprising the step of adding a circumferential lining on the inner surface of said box, said lining having shock loading reactivity properties.

13. The method of claim 10, further comprising the step of forming the shell by folding a unitary moulding and joining teeth and cavities formed on matching edges of said shell.

* * * * *